US009238572B2

(12) United States Patent
Hoyt et al.

(10) Patent No.: US 9,238,572 B2
(45) Date of Patent: Jan. 19, 2016

(54) ORBITAL WINCH

(71) Applicants: Robert Hoyt, Bothell, WA (US); Jeffrey T. Slostad, Lynnwood, WA (US); Scott Frank, Seattle, WA (US); Ian M. Barnes, Kirkland, WA (US)

(72) Inventors: Robert Hoyt, Bothell, WA (US); Jeffrey T. Slostad, Lynnwood, WA (US); Scott Frank, Seattle, WA (US); Ian M. Barnes, Kirkland, WA (US)

(73) Assignee: TETHERS UNLIMITED Inc., Bothell, WA (US)

( * ) Notice: Subject to any disclaimer, the term of this patent is extended or adjusted under 35 U.S.C. 154(b) by 0 days.

(21) Appl. No.: 14/217,434

(22) Filed: Mar. 17, 2014

(65) Prior Publication Data

US 2014/0284531 A1 Sep. 25, 2014

Related U.S. Application Data

(60) Provisional application No. 61/801,910, filed on Mar. 15, 2013.

(51) Int. Cl.
*B66D 1/26* (2006.01)
*B66D 1/38* (2006.01)

(52) U.S. Cl.
CPC ..... *B66D 1/38* (2013.01)

(58) Field of Classification Search
CPC ..... B66D 1/02; B66D 1/04; B66D 1/36; B66D 1/38; B66D 2700/0191
See application file for complete search history.

(56) References Cited

U.S. PATENT DOCUMENTS

| | | | | |
|---|---|---|---|---|
| 3,025,009 | A * | 3/1962 | Aschinger | 242/388.8 |
| 4,045,001 | A * | 8/1977 | Harvey, Jr. | 254/369 |
| 6,631,886 | B1 * | 10/2003 | Caudle et al. | 254/327 |
| 7,594,640 | B1 * | 9/2009 | Mann | 254/294 |
| 2007/0256230 | A1 * | 11/2007 | Phizackerley | 4/502 |
| 2008/0061277 | A1 * | 3/2008 | Grapes et al. | 254/352 |
| 2011/0193037 | A1 * | 8/2011 | Smith | 254/336 |
| 2012/0080652 | A1 * | 4/2012 | Mann | 254/334 |

* cited by examiner

*Primary Examiner* — Emmanuel M Marcelo
(74) *Attorney, Agent, or Firm* — Arthur M. Dula; Scott L. Maddox; Law Office of Art Dula

(57) ABSTRACT

Orbital winch having: lower and upper frames; spool having upper and lower flanges with lower flange attached to lower frame; axial tether guide mounted to upper frame; secondary slewing ring coaxial with spool and rotatably mounted to upper frame, wherein secondary slewing ring's outer surface has gearing; upper tether guide mounted to inner surface of secondary slewing ring; linear translation means having upper end mounted to upper frame and lower end mounted on lower frame; primary slewing ring rotatably mounted within linear translation means allowing translation axially between flanges, wherein primary slewing ring's outer surface has gearing; lower tether guide mounted on primary slewing ring's inner surface; pinion rod having upper end mounted to upper frame and lower end mounted to lower frame, wherein pinion rod's teeth engage primary and secondary slewing rings' outer surface teeth; and tether passing through axial, upper, and lower tether guides and winding around spool.

19 Claims, 5 Drawing Sheets

ORBITAL WINCH

This application claims the benefit of provisional application No. 61/801,910.

STATEMENT REGARDING FEDERALLY SPONSORED RESEARCH & DEVELOPMENT

This invention was made with Government support under contract number NNM04AA10C awarded by NASA. The Government has certain rights in the invention

BACKGROUND

Embodiments relate generally to cable spooling and more particularly to a mechanism for deployment and retraction of long lengths of cables that may be under high tensile load, and doing so without requiring rotation of the spool upon which the cable is wound.

Other winch mechanisms designed for deployment and retraction of high strength cable use rotating spools.

Other winch or cable deployment mechanisms do not have the ability to perform either free or controlled deployment and controlled retraction.

A spin-casting reel used in fishing accomplishes translation of the winding point along the spool axis by moving the spool relative to the enclosing body, not by translating the guide mechanism relative to the spool.

The "Tethered Satellite System" (TSS) deployer flown on the space shuttle used a rotating spool.

The detection of enemy submarines is one the US Navy's most challenging jobs today, in spite of various technologies and modalities developed and fielded over the past several decades. A key tool in the Navy's Anti-Submarine Warfare (ASW) arsenal is the use of magnetic anomaly detection (MAD). The MAD technique calls for a sensitive magnetometer to be towed behind an aircraft close to the surface of the ocean looking for small and short-trace changes in the dip and variation of the magnetic field that may represent the signature of a submerged submarine. This signature is the result of the effective magnetic moment of the submarine, which is a combination of the ferrous mass of the submarine, the fields of its electrical equipment, and the hull currents and dynamic electric fields of the vessel. Since these field disturbances are very small, highly sensitive magnetometers are used to increase the detection range and probability of detection. To maximize the signal to noise of the system, the MAD sensor is most commonly deployed on a towline from an aircraft both to minimize the effect of magnetic noise from the aircraft and to reduce the distance between the sensor and the target, thereby making the measured signal larger. To enable aircraft to fly long missions and reduce operational costs, it is desirable to integrate MAD sensors into small aircraft and in particular unmanned aerial vehicles (UAVs). One key challenge here is the reduced payload capacity of smaller aircraft, which requires that components of the sensor towing system be not only non-magnetic, but also lightweight as well. To benefit from the increased sensitivity and tri-axial capabilities of the latest MAD sensors, such as the AN/ASQ-233 magnetometer, the towed body must be highly stable. A MAD system consisting of an AN/ASQ-233 towed by an unmanned air vehicle would provide the Navy with pervasive ASW reconnaissance with integral targeting. Advanced magnetic anomaly detector's such as Polatimic's AN/ASQ-233 multi-mode magnetic detection system uses an Advanced Optically Driven Spin Precession Magnetometer have sensitivity 100 times better than the current MAD systems in the fleet. This higher sensitivity along with the fact that these sensors produce vector magnetometer measurement are driving the need for these sensors to be towed with greater stability, which for this effort has been determined to be ±0.5° in all three axes.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION

An embodiment provides a stable winch system that in order to increase stability and decrease strain, uses a rotating slewing ring 40 to wind a tether around a stationary spool, as well as a system designed to regulate the tension on the tether due to the payload and to reduce wear on the tether due to abrasion of the tether on itself.

BRIEF DESCRIPTION OF FIGURES

These and other features, aspects, and advantages of an embodiment will become better understood when the following detailed description is read with reference to the accompanying drawings in which like characters represent like parts throughout the drawings.

DETAILED DESCRIPTION

An embodiment can be conceptually similar to a common spincasting reel used for fishing. In a spincasting reel a guide that rotates around the spool wraps the fishing line around the spool, and moving the wind point up and down the spool is accomplished by translating the spool up and down in an oscillatory manner relative to the body of the reel. However, in the case of an orbital winch in accordance with an embodiment, the spool remains fixed relative to the body of the reel, and moving a wind point along the spool axis is accomplished by translating a slewing ring 40 along the spool axis using a mechanism such as a ball screw assembly 30.

An embodiment's preliminary tension management can comprise an arrangement of capstans 50. Capstans 50 may be static or driven. Rollers 60, due to the frictional contact with the tether, provide an arresting force to the tether that allows a much smaller force to be applied at the restraining end than the load that is being held. Furthermore, if rollers 60 are driven in such a way as to pull against the target load, the take up tension at the opposite end would be similarly reduced. However, such a system could be large and heavy, and could require a large amount of power to drive the system due to the losses built up in the gearing of these rollers 60.

Figure 3:
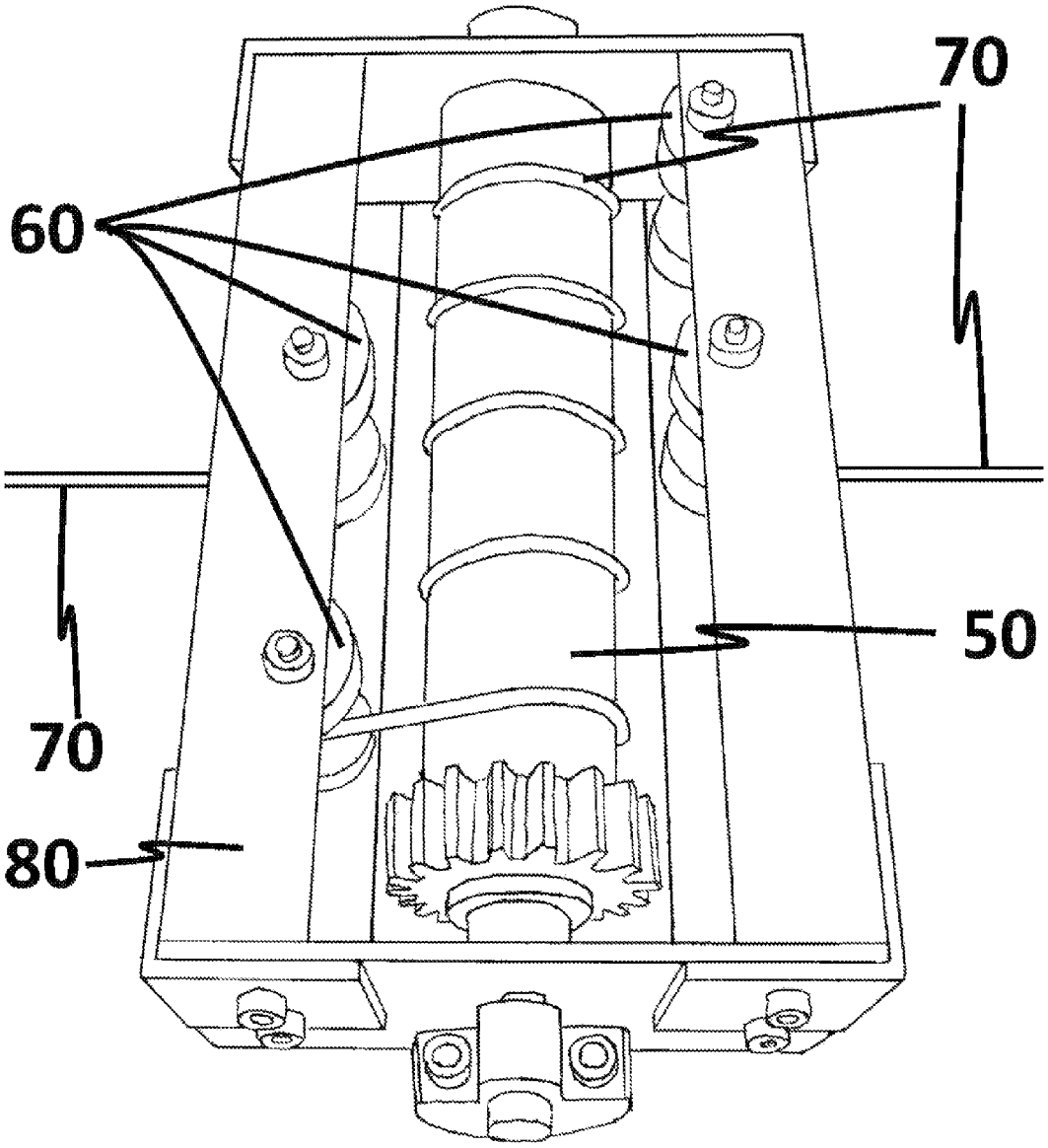
FIG. 3 shows an Orbital Winch in operation under tension in accordance with an embodiment.

For an embodiment where the number of capstans 50 is just one, as shown in FIG. 3, the embodiment can be lighter and fit in a smaller, and more mass efficient and power efficient package.

Since, theoretically, the load reduction due to friction between the capstans 50 and the tether is a function only of the coefficient of friction and the total wrap angle of the tether around the capstans 50, an embodiment could comprise a single capstan 50 with the tether wrapping around the capstan 50 a number of times equivalent to the total wrap angle required for the desired load reduction ratio. For en embodiment where the mission load is 700 N with a 50 N take up tension the ratio is 14:1. The coefficient of friction was experimentally determined to be approximately 0.119. For an embodiment that has 90-degree wraps at the input and output of the system, four additional 270-degree wraps are required to achieve the desired reduction ratio.

Each wrap on the embodiment's capstan 50 is divided by an idler roller 60. This prevents the tether from abrading itself or from having the wraps criss-cross each other, which could result in entanglement. Additionally, the rollers 60 serve to distribute the loads along the capstan 50, and ensure that each wrap makes full contact with the capstan 50.

An embodiment can be configured to handle design load conditions where the total load on the capstan 50 would be 2500 N, imparting a maximum bending stress of 12 MPa, and a maximum shear stress of 1.6 MPa. With a tensile yield strength of 276 MPa for 6061 aluminum tubing (3.8 cm outer diameter, 3 mm wall thickness), there is a factor of safety of 6.7 for the loads expected to be encountered in the demonstration mission.

In this embodiment, the total torque imparted to the capstan 50 by the frictional contact of the wraps is approximately 13 Nm. The capstan 50 drive motor should be able to handle twice the torque (~26 Nm), and pull the 700 N load at approximately 10 cm/s yielding a minimum power requirement of 70 W.

An embodiment can comprise a capstan winch tension management device. It can be constructed out of 6061 aluminum, and comprise hardened steel bearing shafts for the rollers 60 and capstan 50. The capstan 50 can engage the drive motor through a standard spur gear.

Slipping can polish the surface of an aluminum capstan 50, removing the rougher oxide coating and further decreasing the friction coefficient. In certain embodiments, the tether can be threaded into the device, making one full wrap around the capstan 50 between each separator. This results in 360 degrees per wrap (instead of 270), for a total of 2700 degrees, or 15 radians. This larger total wrap angle can enable an embodiment to pull a tether without slipping at a greater load.

A tether can abrade itself in certain embodiments, as additional wraps cause the tether to ride on top of itself. As a result, for a flight embodiment the Tension Management module design should comprise additional idler rollers 60 to enable a larger total wrap angle without chance of the tether overwrapping itself.

Due to differences in friction coefficient from one embodiment to another, certain embodiments may comprise more or less 270 degree wraps. For example one embodiment may comprise ten 270 degree wraps while another only comprises four. A ten wrap embodiment will provide sufficient winching force for a load ratio of 15:1 quite easily, and perhaps as high as 30:1. To achieve this, the idler rollers 60 can be redesigned to be much smaller in order to fit within the same volume, and to maintain the current mass of the system. Additionally, the capstan 50 can be hard anodized to prevent polishing or abrading of the surface, which can both reduce the coefficient of friction as well as produce aluminum dust that can foul the tether and abrade it.

An embodiment comprises an orbital winch winding mechanism to enable deployment or retraction of tether 70 without rotating the spool 90. This has several benefits, including reducing the power required to deploy or retract the tether 70, reducing torques imparted to the host vehicle during winding, and eliminating the need for high-voltage electrical slip-rings if the tether has a conducting element.

Figure 1:
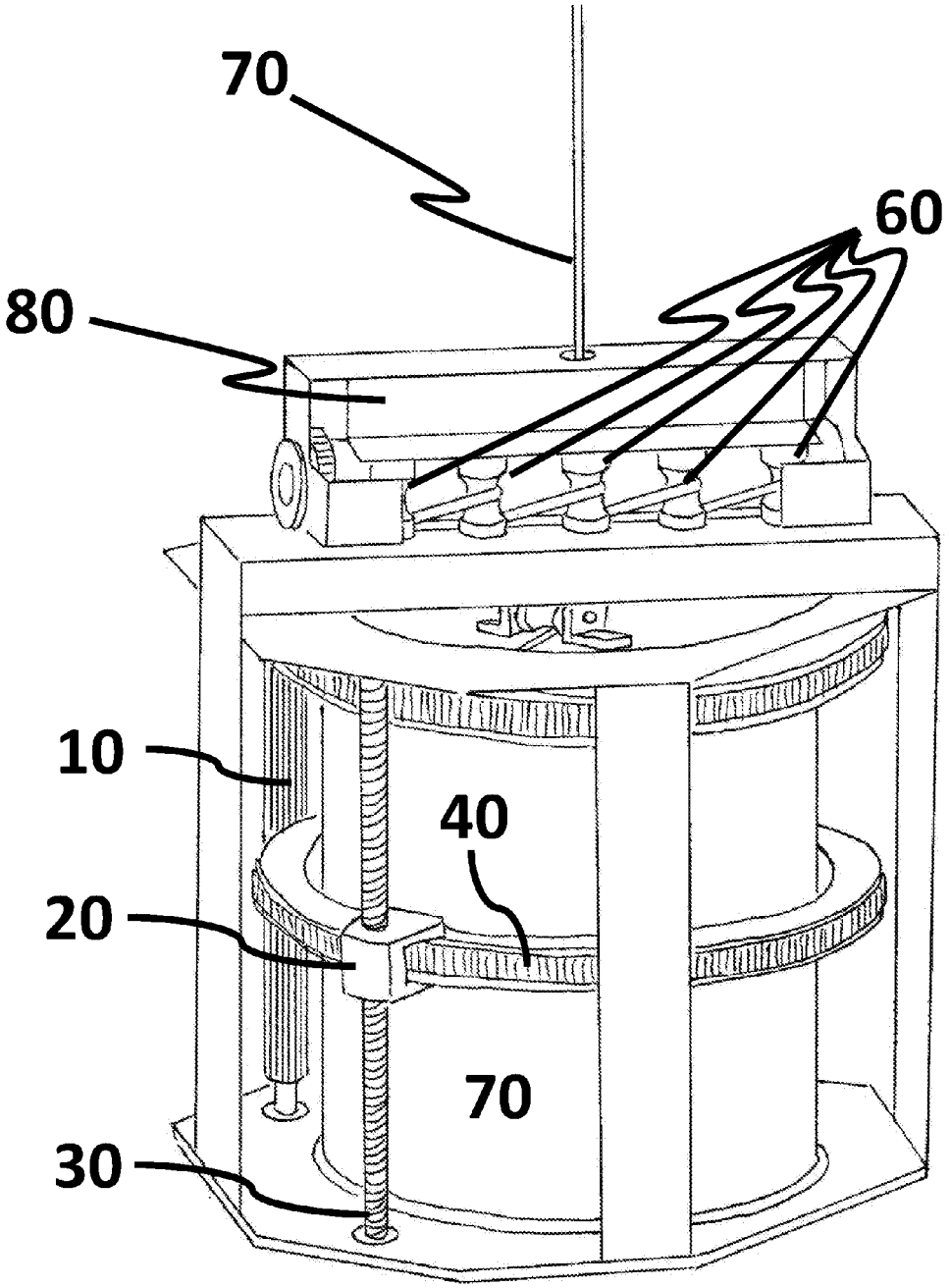
FIG. 1 shows a Tether Rewind System comprising a tension management system and slewing rings 40 that rotate to accomplish winding in accordance with an embodiment.
Figure 4:
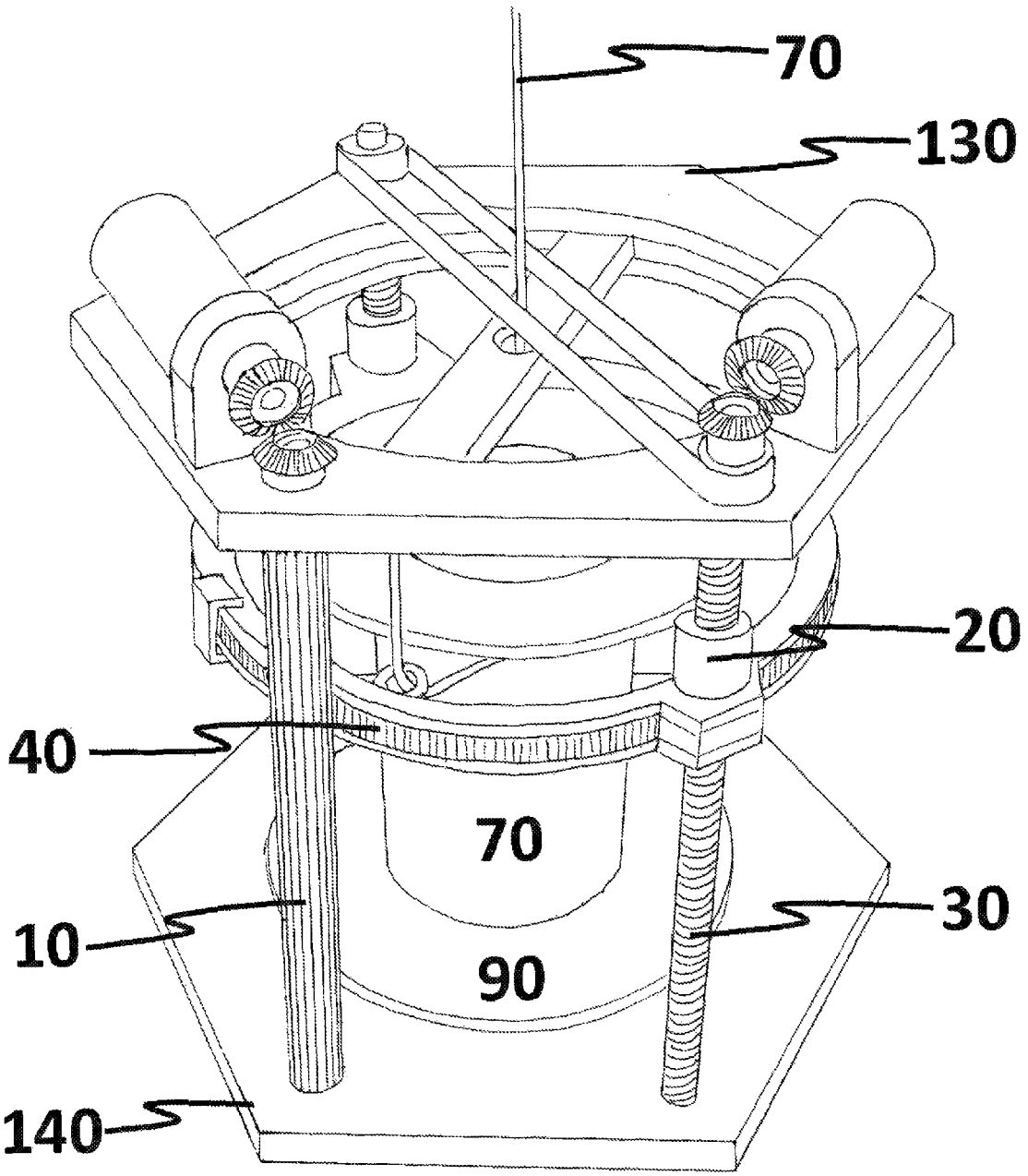
FIG. 4 shows an orbital winch in accordance with an embodiment comprising two ball screws 30 driven in parallel by being mechanically connected with a 1:1 ratio.

A configuration in accordance with an embodiment, shown in FIG. 1, comprises a spool 90 (shown in FIG. 5, but not shown in FIG. 1) located concentrically within two large slewing rings 40. Both rings are driven in rotation by a single actuator driving a pinion rod 10 that meshes with the teeth on the outer surface of the slewing rings 40. The pinion rod 10 is rotatably mounted at one end to lower frame 140 and at the other end to upper frame 130 (as shown in FIG. 4). The purpose of the secondary ring is to prevent the tether 70 from dragging along the flange of the spool.

An embodiment may comprise a second actuator that drives the linear translation along the axis of the spool of the primary slewing ring 40.

Figure 5:
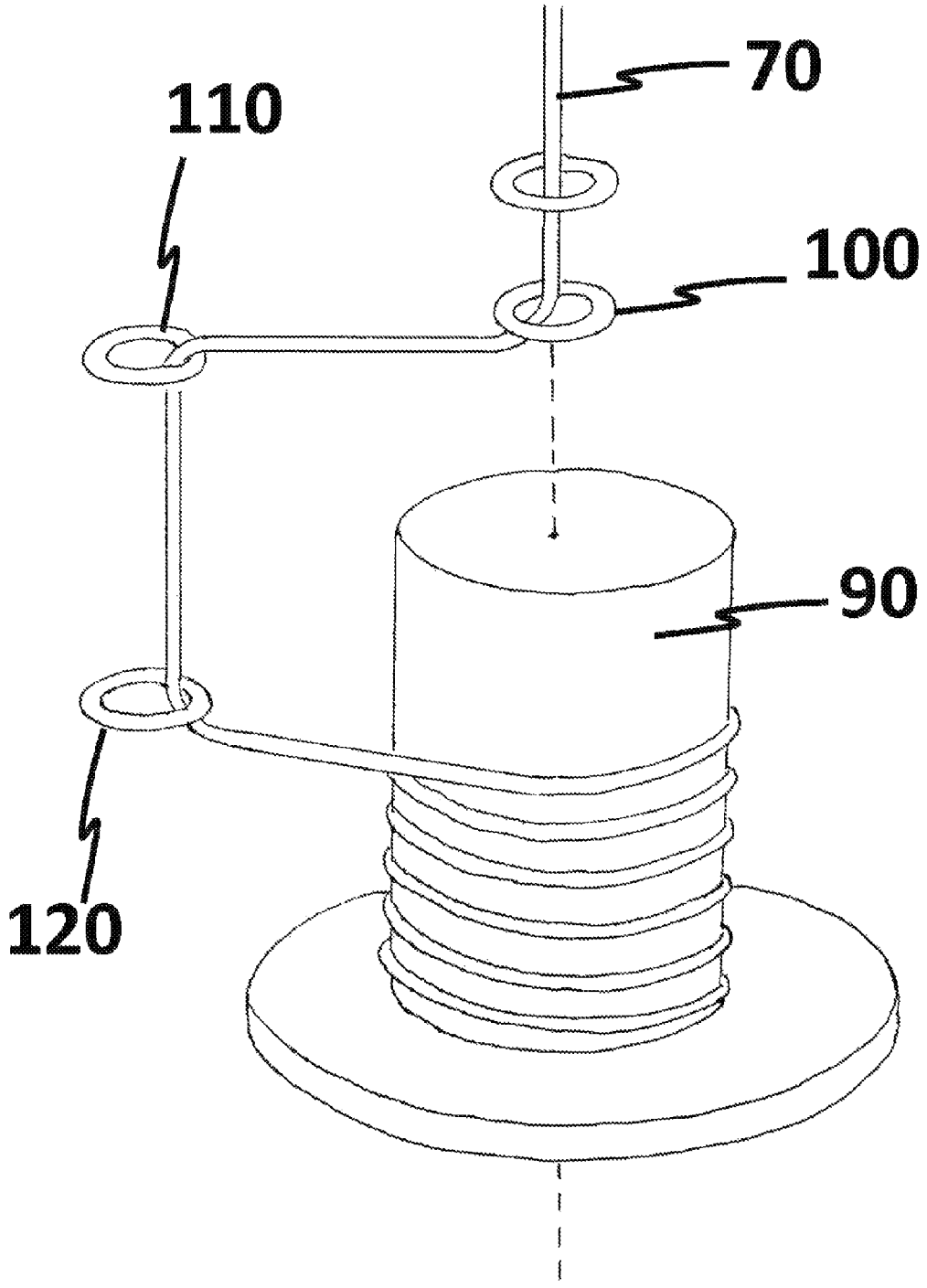
FIG. 5 shows a tether path in accordance with an embodiment.

The tether enters the embodiment's rewind sub-system axially from the tension management subsystem and is redirected radially from an axial tether guide comprising an axial pulley or axial guide ring 100 to the outside of the spool flanges through an upper tether guide comprising an upper guide ring 110 or upper small pulley located on the secondary slewing ring 40. The tether path then traverses axially along the spool to the primary slewing ring 40, where it is redirected to the tether pack on the spool through a pulley or ceramic guide ring 120, as illustrated in FIG. 5.

The embodiment's two actuators are then driven together to obtain the desired winding pitch and tether intake rate. The tether intake rate is the primary driving factor of the actuation rate because it must match the desired intake rate of the tension management system.

An embodiment's rewind system can accept the output load of a tension management system.

Some embodiments can comprise a single lead screw, with a passive linear slide opposite the screw for stabilization. This configuration conserves mass and reduces complexity. The linear slide is meant to constrain the slewing ring 40 by locating the ring relative to the spool and to constrain the end opposite the ball screw 30 to support the ring like a fixed-fixed beam. This makes the ring much stiffer which makes it possible to use only one ball screw 30 in a smaller rewind mechanism. However, sufficient play in the linear slide components could cause the primary ring to jam slightly as the load point from the tether on the ring revolved around the unit. An embodiment with a rewind mechanism of certain magnitude may preferably comprise a second driven ball screw assembly 30.

Some embodiments can comprise two or more ball screws 30 driven in parallel (see FIG. 4 where each ball screw 30 is rotatably mounted in a lower frame 140 at one end and rotatably mounted in an upper frame 130 at the other end). This configuration requires that the ball screws 30 be mechanically connected with a 1:1 ratio. A dual (or multiple) ball screw configuration makes it possible for the slewing ring 40 to handle higher tether loads, and prevents the ring from torqueing, and consequently jamming. However, a dual ball screw configuration can also cause the system to jam if the drive system between the ball screws 30 slips or if they are not clocked correctly. This issue is greatly reduced with a larger embodiment that can flex slightly and allow for some variations in the drive system.

Embodiments can be scalable and can be very large or very small while being strong for their size and weight. An embodiment comprising an orbital winch can pull a 49 N load, and coupled with the tension management system should be capable of winding tether under ~800 N loading conditions. An embodiment can operate smoothly in all transitions of direction along the spool axis. Certain embodiments can have minimal mass. For a modular MXER system architecture, minimizing the mass of the deployer hardware is preferred, because the mass of deployers distributed along the length of the tether have a very strong impact on the tether mass required. Embodiments have non-rotating spools. For MXER and other tether applications, tether deployment and winding can be accomplished without rotating the spool. Such a design will have a number of advantages: first, it minimizes rotational torques on the spacecraft; second, it can minimize the power required to accomplish deployment or retrieval; and third, it eliminates the need for a rotating high-voltage electrical joint in systems that use electrodynamic tether propulsion.

An embodiment could have fast deployment/controlled retraction capability. There are two different approaches that are possible for deploying a tether in orbit. The first is to impulsively eject a tethered endmass away from the host spacecraft and rely upon the endmass's momentum to pull the tether out of the deployer until gravity gradient forces become large enough to continue to pull the tether out. This method has been demonstrated successfully on several flight missions, including the SEDS-1, SEDS-2, and PMG experiments. It requires the capability for relatively fast deployment, on the order of several meters per second, and low deployment tensions. The second method is to push the endmass gently away from the host and actively feed the tether out at just the right rate to match the endmass's velocity. This method is more complex to achieve. It was demonstrated successfully on the TSS-1R mission, but problems with this deployment method led to the premature termination of NRL's ATEx experiment on the STEX spacecraft. For the MXER tether system and several other space and terrestrial tether applications, it would be advantageous to be able to utilize either deployment method with minimal or no modifications to the deployer hardware, so that a single mechanism can be used for rapid deployment of cable at low tensions and for slow, controlled retraction of tether at high tensions.

An embodiment could comprise multi-line tether capability. To ensure that the MXER tether can survive the micrometeoroid and space debris (M/OD) environment for long durations, an embodiment can comprise a multi-line tether structure, called the Hoytether™, that provides multiply redundant load-bearing paths within the tether's structure. In handling, however, the Hoytether, behaves as much like a net as it does a cable, and as a result special care must be taken in winding, deploying, and retracting it to prevent tangling of the multiple lines in the structure.

An embodiment can comprise a Tension Management Module to minimize tether wear. A significant challenge for implementing a MXER tether system is the fact that in operation, the deployed tether will often be under extremely high loading, at 50% or more of its breaking load, and in order to prevent damage to the tether as it is retracted and wound onto a spool, this tension should be transitioned gracefully from the tether fibers to the deployer structure before the tether is wound. This transition should be accomplished with minimal abrasion or crimping of the tether to prevent stress concentrations that could cause fiber failure.

Figure 2:
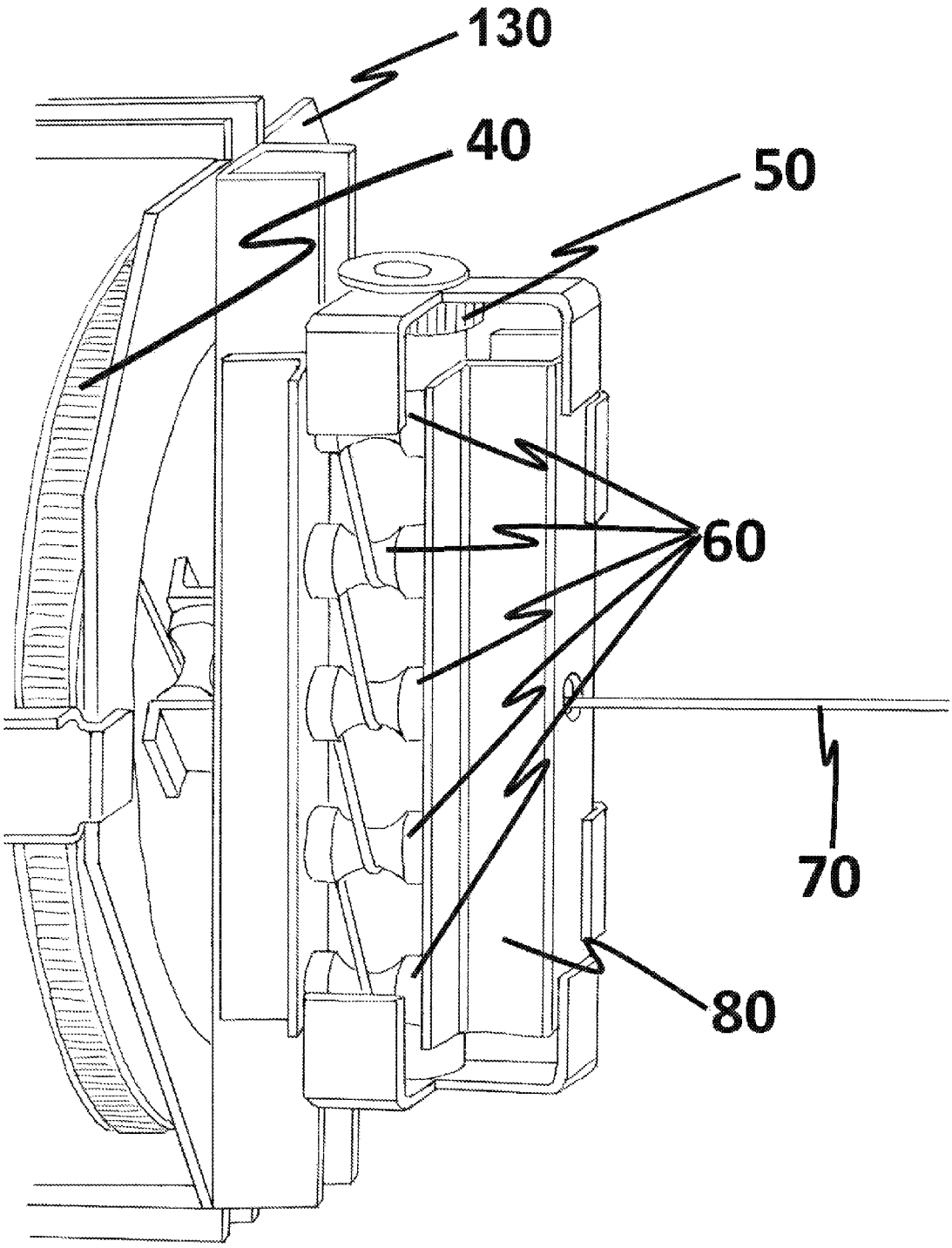
FIG. 2 shows a Tension Management Module comprising spaced rollers 60 and capstan 50 around which the tether runs in accordance with an embodiment.

An embodiment comprising a tether deployer, as shown mounted on an upper frame 130 in FIG. 2, meets all of these goals. This tether deployer combines an 'orbital winch' reeling mechanism, so named because winding of the tether is accomplished by a slewing ring 40 that orbits the tether spool, with a tension management module that reduces the tension on the tether by a factor of 15 between the deployed tether and the tether wound on the spool.

The tether deployer according to an embodiment shown in FIG. 2 is sized and optimized for a MXER-1 demonstration mission. This design minimizes its mass by utilizing the structure of its host spacecraft to provide a significant portion of the structural support and stiffness that it requires for launch and operation. The mass of an embodiment sized to deploy a 17 kg, 15 km long tether, comprising Orbital Winch, Tension Management Module, and associated motors and motor drivers, could be approximately 10 kg. The embodiment shown is designed for slow, controlled deployment and retraction of tether. With the addition of an actuator and a 'swing-arm' guide as is used on spincasting reels in sport fishing, this mechanism can be modified to enable rapid, low-tension deployment of tether off the end of the spool in addition to the controlled high-tension deployment and retraction.

Certain embodiments can comprise a small MXER tether system capable of enabling responsive launch of nano- and micro-satellites to high altitude orbits. The capability to deploy satellites into orbit within days of a 'go' order requires launch systems that can be loaded, prepared, and launched very rapidly. Embodiments enable small, low-cost launch systems capable of rapid response times.

An embodiment's orbital winch mechanism enables high-load tethers to be deployed and retracted without rotating the spool on which the tether is wound. An orbital winch mechanism eliminates the need for rotating high-voltage electrical connections in tether systems that use propellantless electrodynamic propulsion. It will also eliminate the need for rotating optical connections in applications where the tether contains optical fibers.

An embodiment's orbital winch mechanism eliminates the need for rotating high-voltage electrical connections in tether systems that use propellantless electrodynamic propulsion. It will also eliminate the need for rotating optical connections in applications where the tether contains optical fibers. Embodiments can incorporate a tension management module that enables deployment and retraction of tethers under very high loads while preventing damage to the tether and wound package during reeling maneuvers.

Potential commercial applications include deployment of high strength tethers containing optical fibers and/or electrical conductors for systems such as tethered aerostats, tethered wind turbines, and UAV-deployment of tethered sensors.

An embodiment's orbital winch mechanism is designed to deploy and retract long lengths (10's to 10,000's of meters) of cable. The cable may be under tensile loads ranging from zero tension (slack cable) to very high tension (up to 100% of the breaking strength of the cable). The cable may comprise a single strand of material (braided, knitted, twisted, or monofilament), or may comprise multiple individual strands that are periodically interconnected, such as a Hoytether structure. The cable may comprise textile yarns, optical fibers, conducting wires, or any combination of these.

FIG. 4 shows a spool 90 fixedly mounted to a lower frame 140. A unique feature of an embodiment's Orbital Winch is that deployment and retraction of a cable is accomplished without rotation of the spool upon which the cable is stored. Instead, the cable 70 is brought into the mechanism along one axis of the spool 90, and fed around to the side of the spool by a set of guides 100, 110, 120. The cable is then wound onto or off of the spool 90 by a pair of slewing rings 40 that rotate around the axis of the spool 90. Rotation of the slewing rings 40 can be accomplished using a pinion rod 10 engaged with gearing on the exterior of the slewing rings 40. Control of the axial traverse of the winding point is achieved by translating one of the slewing rings 40 along the axis of the spool. Slewing ring 40 translation can be achieved by a mechanism such as a ball screw 30 and nut 20 assembly, where a nut 20 is fixedly attached to a slewing ring 40 and the nut 20 mates with a ball screw 30 so that rotation of the ball screw 30 causes the nut 20 and attached slewing ring 40 to translate along ball screw's 30 length. FIG. 4 shows one end of ball screw 30 rotatably mounted in lower frame 140 and the other end of ball screw 30 rotatably mounted in upper frame 130. In all embodiments, pinion rods 10 and ball screws 30 should be parallel to the spool's axis to ensure that, as they engage a slewing ring 40, the spool 90 and slewing ring 40 remain coaxial as the slewing ring rotates and translates. A means for linear translation of the primary slewing ring 40 or other guide mechanism along the spool axis could comprise a set of actuated cables connected to the slewing ring 40, rather than the ball screw assembly 30, 20.

As shown in FIGS. 1, 2, and 3, according to some embodiments, an orbital winch can be integrated with a tension control module (TCM), comprising one or more powered capstans 50, which can serve as a traction winch to reduce the cable tension before it is wound onto a spool 90. This reduction in cable tension by the TCM mitigates abrasion and compression damage to the cable 70 wound on the spool 90, and enables the embodiment's actuators to be sized for relatively low torques. A unique feature of an embodiment's tension control module design is that it utilizes several guide rollers 60 to ensure that as the cable 70 makes multiple wraps around the powered capstan 50, it maintains proper spacing between the wraps so that the cable does not experience damage due to rubbing against or over itself. This spacing of the wraps also prevents loose strands in a multi-stranded structure, such as a Hoytether cable, from becoming pinched under adjacent wraps and causing binding of the mechanism.

In applications where cable tensions are not large, an embodiment's Tension Management Module can be replaced by a set of pinch rollers. These pinch rollers can ensure the cable is fed out of the winch properly during deployment, and during retraction can ensure that the cable being wound inside the mechanism has is tensioned sufficiently to permit proper winding.

Achieving winding of the cable without rotating the spool has several advantages. First, compared to a rotating-spool winch, it reduces the torques imparted by the winch upon the body that contains it. Second, changing the speed and direction of winding does not require rotational acceleration of the spool, so deployment rates and directions can be changed faster and with lower power requirements than a rotating spool system. Third, if the cable contains conducting wires or optical fibers, an embodiment comprising an orbital winch eliminates the need for rotating slip-ring feedthroughs for the electrical and optical signals. Fourth, if the winding is accomplished by a guide system that can release and later re-engage the cable, an embodiment can deploy the cable in either a controlled manner, in which the feed system controls the rate at which the cable winds off the spool, or in a free deployment manner, in which the cable can deploy very rapidly, at low drag and tension, off the end of the spool. The guide system can then re-engage the cable and wind it back onto the spool in a controlled manner.

The two slewing rings 40 and associated guides could be replaced by a mechanism that would also rotate around the spool's axis, but could release and later re-capture the cable, in a manner similar to the swing-arm on a spincasting reel. This would enable free-deployment of the cable from the spool in an end-off manner followed by controlled retraction and winding of the cable. This mechanism could be designed to flip out of the way or retract into a cavity in the shroud or enclosure of the winch mechanism to mitigate chances of snagging of the cable on the mechanism during free deployment.

To maximize embodiments' adaptability to any number of vehicles, the drag of the towed body can be reduced through the use of an actively controlled lifting body design. This has the added benefit of reducing the torque requirements on the motors as well as the strength requirements of load bearing members of the system. The towing cable can be constructed using fiber optics for communication, copper wires for power, and an aramid fiber layer for strength. This cable can be deployed and retrieved using an embodiment's orbital winch that does not spin the spool further reducing motor torque requirements and eliminating the need for slip joints for data and power. An embodiment can meet these requirements with a total mass of 16.9 kilograms.

Embodiments can be of benefit to towing systems that require electrical power and/or signals between the vehicle and towed body as the unique deployer/retriever design eliminates the need for slip rings further reducing the mass and cost of the overall system, particularly for systems that tow sensors or active decoys. In addition to DoD-related applications, embodiments may enable UAV-based tethered sensors to compete effectively in the commercial arena for applications such as mineral and petroleum exploration eliminating the need for large aircraft.

An application for certain embodiments is a "Small VEhicle Lightweight Towing Equipment" (SVELTE) system to enable small aircraft and UAVs to deploy and tow magnetic anomaly detection sensors with highly stable sensor attitude. An embodiment could comprise a AN/ASQ-233 sensor towing system for UAVs that having a system weight less than 40 pounds (18.14 kg) while achieving sensor tow body stability objectives of ±0.5° in all three axes. To meet the weight limit for the towing system an embodiment can integrate an orbital winch mechanism with a lightweight towing cable capable of providing data and power transfer to the sensor payload. Embodiments can integrate inertial sensors and active control surfaces into the towed endbody.

To maximize embodiments' adaptability to any number of vehicles, the drag of the towed body can be reduced through the use of an actively controlled lifting body design. This has the benefit of reducing the torque requirements on the motors as well as the strength requirements of load bearing members of the system, saving weight on both components. The towing cable can be constructed using an optical fiber link for communication, copper wires for power, and an aramid fiber layer for strength to minimize the mass and diameter of the cable. This cable can deployed and retrieved using an embodiment's orbital winch mechanism, which accomplishes reeling without spinning the spool, thereby further reducing motor torque requirements and eliminating the need for slip joints for data and power. The resultant system meets all of the requirements with a total mass of 16.9 kg.

Embodiments can weigh less than 40 pounds and meet sensor tow body stability objectives of ±0.5° in all three axes.

At the top level, the system comprises: stabilizing towed body, towing cable with data and power components, and deployment/retrieval winch with docking mechanism. Due to the high sensitivity of the AN/ASQ-233 sensor, it is preferred that the magnetic cleanliness of the individual components and overall system be maintained so as to maximize the probability of detection.

A towed body could fit around the AN/ASQ-233 sensor. A towing cable could have appropriate power and communication capabilities as well as towing strength capabilities. An embodiment could provide the required cable handling, deployment, towing and retrieval capabilities to a MAD-Tow system. A system could also comprise restraint, release and docking mechanisms for the towed body. All of these system components could have estimated masses within a 40 lb (18.14 kg) upper mass limit.

In order to evaluate the effects of tether dynamics on the stability of towed bodies in the MADTow system and ensure that the SVELTE towing system will meet operational requirements for attitude stability of the magnetic sensor payload, TetherSim code can incorporate the aerodynamic drag and lift forces on both the tow cable and a towed body so as to enable simulation of dynamical behavior of the system in flight.

Simulations of passive-drag stabilized tow bodies indicate that although a simple drag empennage can stabilize the attitude of the tow body to meet the stability requirements for the MAD tow sensor in quiet air, a relatively large empennage is required, and, moreover, this passive system will not sufficiently stabilize the attitude in the presence of significant wind gusts (see FIG. 5.) Consequently, if the ±0.5° requirement must be met in all likely weather conditions, an actively stabilized tow body will be required to meet the stability requirements. An additional benefit of using a tow body with wings to provide lift is that it can significantly reduce the tether tensions and thus the power the UAV must expend to tow the MAD sensor payload.

A candidate towed body for the SVELTE MAD-Tow system could comprise a cylindrical fuselage containing the AN/ASQ-233 sensor with wings to provide lift as well as longitudinal stability, and vertical stabilizer to provide lateral stability. The bird could be sized around a 10 kg magnetometer tube, and should be suitable for towing over speeds from about 30 m/s to about 200 m/s (although it would be stalled at the low end of the speed range). This towed body design will use active control to achieve the desired attitude stability requirements of ±0.5°. Active control can be used to enhance both stiffness and damping, without adding weight or drag.

Active control for an embodiment could be accomplished with: two potentiometers or equivalent sensors to measure the angles of a gimbaled tether attachment; a flight computer such as a Cloud Star Technologies Piccolo, which includes a pitot/static sensor, GPS, rate gyros, and state estimators suitable for supplying airspeed, groundspeed, orientation, and orientation rate; one large model-aircraft servo for each of the three control surfaces i.e. left elevon, right elevon, and rudder.

A flight computer could be mounted anywhere in the fuselage, oriented per the manufacturer's specifications. These should be effective not only when the tether is long, but also for a short tether, as when reeling the bird in or out. Dynamics during launch and retrieval of the bird and the interaction of the bird with the towing UAV's wake would be a point of particular interest for study during flight tests.

While only certain features of certain embodiments have been illustrated and described herein, many modifications and changes will occur to those skilled in the art. It is, therefore, to be understood that the appended claims are intended to cover any such modifications and changes as fall within the true spirit of an embodiment.

What is claimed is:

1. An orbital winch comprising:

a lower frame and an upper frame;

a spool having an upper flange and a lower flange wherein said lower flange is fixedly attached to said lower frame;

an axial tether guide that is mounted to said upper frame;

a secondary slewing ring having an inner surface and an outer surface, wherein said secondary slewing ring is coaxial with said spool and rotatably mounted to said upper frame at least as high up as said spool's upper flange, wherein said secondary slewing ring comprises gearing on its outer surface;

an upper tether guide mounted to the inner surface of said secondary slewing ring;

a linear translation mechanism having an upper end and a lower end wherein said linear translation mechanism's upper end is mounted to said upper frame and said linear translation mechanism's lower end is mounted on said lower frame;

a primary slewing ring having an inner surface and an outer surface, wherein said primary slewing ring is coaxial with said spool and is rotatably mounted within said linear translation mechanism to allow said primary slewing ring to translate axially between said spool's upper and lower flanges, wherein said primary slewing ring comprises gearing on its outer surface;

a lower tether guide mounted on said primary slewing ring's inner surface;

a pinion rod having an upper end and a lower end, wherein said pinion rod's upper end is rotatably mounted to said upper frame and said pinion rod's lower end is rotatably mounted to said lower frame, wherein said pinion rod has gearing that engages the gearing on said secondary slewing ring's outer surface and that engages the gearing on said primary slewing ring's outer surface; and a tether that passes through said axial tether guide, said upper tether guide, said lower tether guide, and winds around said spool.

2. The orbital winch of claim 1 wherein said linear translation mechanism comprises a ball screw assembly having a nut and a screw that has a top end and a bottom end, wherein said screw's top end is rotatably mounted to said upper frame and said screw's bottom end is rotatably mounted to said lower frame.

3. The orbital winch of claim 2 wherein said nut translates axially when said screw rotates and wherein said nut engages said primary slewing ring such that said primary slewing ring and said nut translate along said spool's axis.

4. The orbital winch of claim 3 wherein said linear translation mechanism comprises a second ball screw assembly having a second nut and a second screw that has a top end and a bottom end, wherein said second screw's top end is rotatably mounted to said upper frame and said second screw's bottom end is rotatably mounted to said lower frame.

5. The orbital winch of claim 4 wherein said second nut translates axially when said second screw rotates and wherein said second nut engages said primary slewing ring such that said primary slewing ring and said second nut translate along the axis of said spool.

6. The orbital winch of claim 5 wherein said linear translation mechanism comprises a linear translation actuator that drives said screw and said second screw to cause said screw and said second screw to rotate.

7. The orbital winch of claim 5 wherein said screw and said second screw are parallel to said spool's axis.

8. The orbital winch of claim 2 wherein said linear translation mechanism comprises a linear slide assembly located on the opposite side of said spool from said ball screw assembly, wherein said linear slide assembly comprises a slide and a rigid member having a top end and a bottom end; wherein said rigid member's top end is mounted to said upper frame and said rigid member's bottom end is mounted to said lower frame.

9. The orbital winch of claim 8 wherein said slide is slidingly connected to said rigid member and wherein said slide engages said primary slewing ring.

10. The orbital winch of claim 2 wherein said linear translation mechanism comprises a linear translation actuator that drives said screw to cause said screw to rotate.

11. The orbital winch of claim 1 wherein said linear translation mechanism comprise a plurality of actuated cables that run between said upper frame and said lower frame, wherein said actuated cables engage said primary slewing ring such that actuation of said actuated cables causes said primary slewing ring to move along said spool's axis.

12. The orbital winch of claim 1 wherein said pinion rod is parallel to said spool's axis.

13. The orbital winch of claim 1 further comprising a pinion rod actuator that engages said pinion rod and causes said pinion rod to rotate such that:

said pinion rod's gearing engages said primary slewing ring's outer surface gearing such that said primary slewing ring rotates around said spool; and said pinion rod's gearing engages said secondary slewing ring's outer surface gearing such that said secondary slewing ring rotates around said spool.

14. The orbital winch of claim 1 further comprising a tension management module mounted on said upper frame.

15. The orbital winch of claim 14 wherein said tension management module comprises a rotatably mounted capstan around which said tether is wound.

16. The orbital winch of claim 15 wherein said tension management module further comprises a capstan actuator that causes said rotatably mounted capstan to rotate.

17. The orbital winch of claim 16 wherein each wrap of said tether around said rotatably mounted capstan is interrupted by a wrap around one of said guide rollers.

18. The orbital winch of claim 15 wherein said tension management module further comprises a plurality of guide rollers that are rotatably mounted adjacent to said rotatably mounted capstan, wherein said guide rollers are positioned such that as said tether wraps around said rotatably mounted capstan proper spacing is maintained between wraps.

19. The orbital winch of claim 14 wherein said tension management module comprises pinch rollers that engage said tether.

* * * * *